United States Patent [19]

Tada et al.

[11] Patent Number: 5,034,580

[45] Date of Patent: Jul. 23, 1991

[54] COLLISION SENSOR

[75] Inventors: Tatsuo Tada; Katsuhisa Tonooka, both of Fujisawa, Japan

[73] Assignee: Nippon Seiko Kabushiki Kaisha, Tokyo, Japan

[21] Appl. No.: 529,328

[22] Filed: May 29, 1990

[30] Foreign Application Priority Data

Jun. 1, 1989 [JP] Japan ..... 1-64302[U]
Jan. 16, 1990 [JP] Japan ..... 2-2475[U]

[51] Int. Cl.[5] ..... H01H 35/14
[52] U.S. Cl. ..... 200/61.45 R; 200/61.48
[58] Field of Search ..... 200/61.45 R, 61.4 C, 200/61.48–61.53, 61.45

[56] References Cited

U.S. PATENT DOCUMENTS

| | | | |
|---|---|---|---|
| 3,749,863 | 7/1973 | Kaiser | 200/61.45 R |
| 3,967,135 | 6/1976 | Balban et al. | 307/121 |
| 4,022,997 | 5/1977 | Inagaki et al. | 200/61.48 X |
| 4,188,517 | 2/1980 | Narita et al. | 200/61.45 R |
| 4,362,913 | 12/1982 | Kumita et al. | 200/61.48 X |

FOREIGN PATENT DOCUMENTS 53-39263 9/1978 Japan .

*Primary Examiner*—J. R. Scott
*Attorney, Agent, or Firm*—Wegner, Cantor, Mueller & Player

[57] ABSTRACT

A collision sensor adapted to sense acceleration applied thereto in the event of collision of a vehicle and actuate an occupant protective system. A rotary element has an outer peripheral surface thereof provided with a predetermined curvature characteristic. A biasing device generates a biasing force for biasing the rotary element to a predetermined reference position. An inertial mass is responsive to acceleration acting thereupon for causing the rotary element to rotate from the predetermined reference position against the biasing force. A switch is operable to generate an output signal when the rotary element has rotated by a predetermined angle from the predetermined reference position. The biasing force of the biasing means is modulated in accordance with the predetermined curvature characteristic of the outer peripheral surface of the rotary element as the rotary element rotates.

22 Claims, 13 Drawing Sheets

COLLISION SENSOR

BACKGROUND OF THE INVENTION

This invention relates to a collision sensor which is adapted to sense acceleration applied thereto in the event of collision of a vehicle and actuate an occupant protective system such as an inflatable air-bag system upon sensing of the acceleration.

Conventionally, a collision sensor of this kind has been proposed e.g. by Japanese Utility Model Registration Publication (Kokoku) No. 53-39263, which has a rotary plate having a center of gravity eccentric to an axis thereof such that the rotary plate rotates in response to acceleration applied thereto when a vehicle is involved in a crash, for instance, and a switch mechanism operable to actuate an occupant protective system when the rotary plate rotates by a predetermined angle.

According to the proposed device, however, the rotary plate is normally biased in a reference position by a spiral spring so that the force of the spiral spring increases as the rotary plate rotates away from the reference position to thereby increase its urging force acting on the rotary plate. That is, as the rotary plate rotates from the reference position by a predetermined angle, the force of the spiral spring correspondingly increases from the minimum value to the maximum value. Therefore, the proposed device had the disadvantage that there is a limitation in selecting a spiral spring having a suitable spring constant for the degree of acceleration which should occur in the event that the vehicle is involved in a crash, for instance, thereby spoiling the freedom of design or selection of the spiral spring. This problem is still encountered even if a leaf spring is used in the collision sensor in place of the spiral spring.

SUMMARY OF THE INVENTION

It is an object of the invention to provide a collision sensor which is capable of varying the intensity of the force of a single spring acting upon a sensing inertial mass in accordance with a desired given pattern while the sensing inertial mass is being moved over a predetermined distance from a reference position, when the vehicle is involved in a crash.

It is another object of the invention to expand the range of the spring constant that can be selected to detect desired patterns of acceleration, thereby improving the freedom of selection and design of the spring.

To achieve the above objects, the present invention provides a collision sensor comprising:

a rotary element having an outer peripheral surface thereof provided with a predetermined curvature characteristic;

biasing means for generating a biasing force for biasing the rotary element to a predetermined position;

inertial mass means responsive to acceleration acting thereupon for causing the rotary element to rotate from the predetermined position against the biasing force;

switch means operable to generate an output signal when the rotary element has rotated by a predetermined angle from the predetermined position; and modulating means associated with the outer peripheral surface of the rotary element for modulating the biasing force of the biasing means in accordance with the predetermined curvature characteristic as the rotary element rotates.

In a first form of the invention, the collision sensor comprises:

a rotary element rotatable about an axis of rotation thereof, the rotary element having an outer peripheral surface thereof provided with a predetermined curvature characteristic;

an elongate flexible element wound on at least part of the outer peripheral surface of the rotary element;

basing means for generating a basing force for biasing the rotary element through the flexible element to a predetermined position;

the biasing force of the biasing means being modulated in accordance with the predetermined curvature characteristic as the rotary element rotates;

weight means arranged on the rotary element at a location deviated from an axis of rotation of the rotary element, the weight means being responsive to acceleration acting thereupon for causing the rotary element to rotate against the biasing force from the predetermined position; and switch means operable to generate an output signal when the rotary element has rotated by a predetermined angle from the predetermined position.

In the first and second forms of the invention, the outer peripheral surface of the rotary element has a region upon which the biasing force acts through the elongate flexible element at least while the rotary element rotates by the predetermined angle from the predetermined position. The above region has a constant radius of curvature from a starting end thereof to a terminating end thereof.

Alternatively, the above region may have a radius of curvature progressively increasing from the starting end to the terminating end. Inversely, the radius of curvature may progressively decrease from the starting end to the terminating end.

Restraining means may be provided for applying to the rotary element a restraining force progressively increasing as the rotary element rotates away from the predetermined position.

In a second form of the invention, the collision sensor comprises:

a rotary element rotatable about an axis thereof, the rotary element having an outer peripheral surface thereof provided with a predetermined curvature characteristic;

a weight element formed in a separate body from the rotary element, the weight element being movable in response to acceleration acting thereupon against a biasing force from a predetermined position;

an elongate flexible element having one end thereof secured to the weight element, and another end portion thereof wound on the outer peripheral surface of the rotary element;

biasing means engaging with the rotary element for generating the biasing force for biasing the weight element to the predetermined position through the elongate flexible element;

the biasing force of the biasing means being modulated in accordance with the predetermined curvature characteristic as the rotary element rotates; and switch means operable to generate an output signal when the weight element has moved by a predetermined distance from the predetermined position.

The above and other objects, features, and advantages of the invention will become more apparent from the ensuing detailed description taken in conjunction with the accompanying drawings.

DETAILED DESCRIPTION

Figure 1:
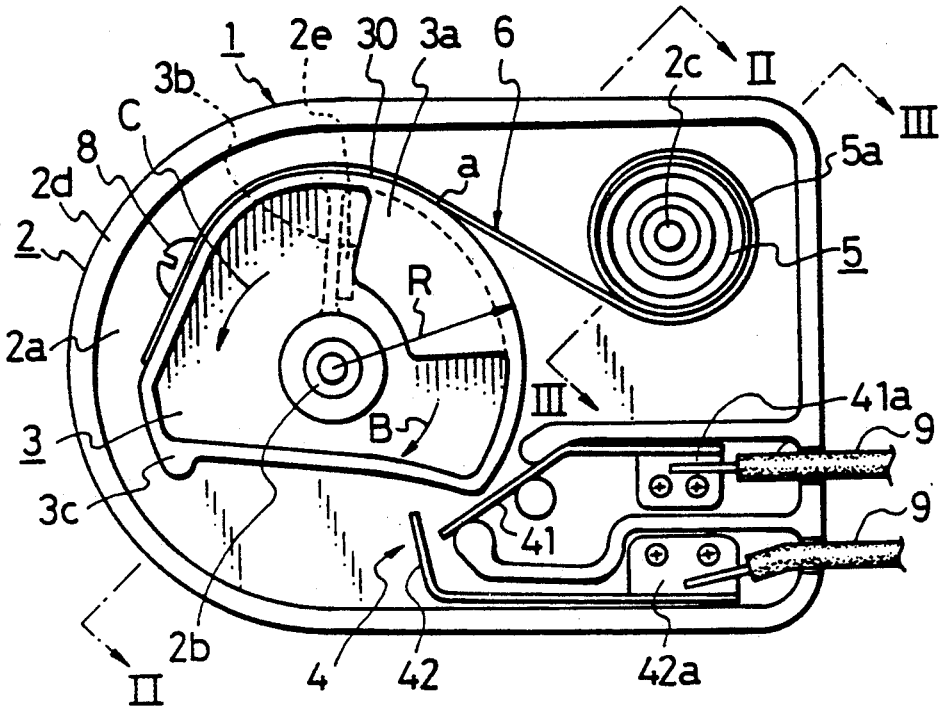
FIG. 1 is a plan view of a collision sensor according to a first embodiment of the invention, wherein an upper cover is removed and a rotary plate is in a reference position.

The invention will now be described in detail with reference to the drawings showing embodiments thereof. In the embodiments, the same reference numerals are used to designate like or corresponding component parts.

Referring first to FIGS. 1 through 4, there is illustrated a collision sensor according to a first embodiment of the invention. As shown in the figures, the collision sensor 1 comprises a lower cover 2, a support shaft **2*b* projected integrally from a bottom wall 2*b* of the lower cover 2, a rotary plate (rotary element) 3 as a sensing inertial mass rotatably supported by the support shaft 2*b*, a switch 4, a drum 5 rotatably supported on a support shaft 2*c* projected integrally from the bottom wall 2*b* of the lower cover 2, a spring 6 in the form of a band, having one end thereof wound around an outer peripheral surface 5*a* of the drum 5 and the other end thereof extending along part of an outer peripheral surface 30 of the rotary plate 3 and secured thereto by a set screw 8, and an upper cover 7 mated with the lower cover 2** to form a casing.

The rotary plate 3 has a weight **3*a* formed integrally therewith at such a location that the center of gravity of the plate 3** is deviated from the axis of rotation thereof.

Figure 2:
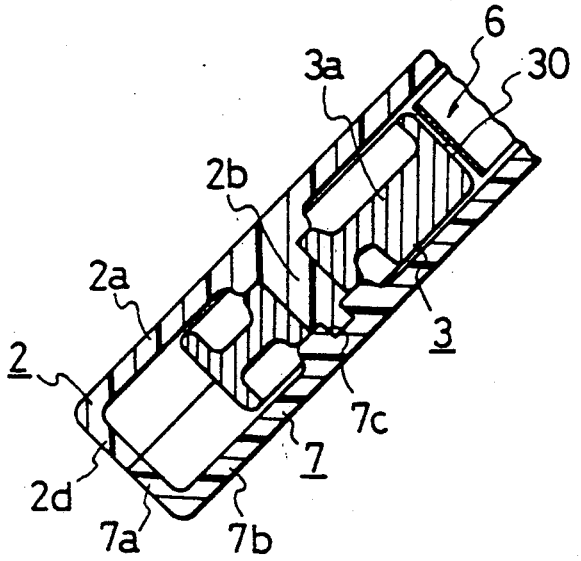
FIG. 2 is a sectional view taken along line II—II in FIG. 1.
Figure 3:
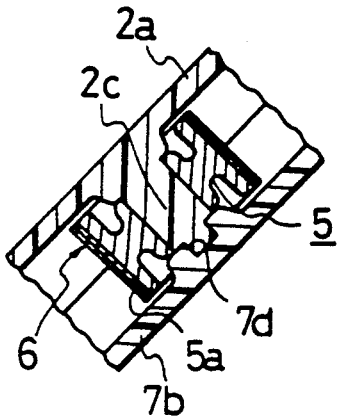
FIG. 3 is a sectional view taken along line III—III in FIG. 1.

The lower and upper covers 2, 7 have respective peripheral walls **2*a*, 7*a* abutting against each other when the covers 2, 7 are assembled. The upper cover 7 has recesses 7*c* and 7*d* formed in an upper wall 7*b* thereof opposed to the bottom wall 2*a* of the lower cover 2, in which the support shafts 2*b* and 2*c* of the upper cover 2 are fitted, respectively, as shown in FIGS. 2 and 3. A stopper 2*e* is projected integrally on the bottom wall 2*a* of the lower cover 2 to limit the rotation of the plate 3**.

The band-shaped spring 6 assumes a given curvature slightly larger than that of the outer peripheral surface **5*a* of the drum 5 while it is in a free state, and is wound around the outer peripheral surface 5*a* of the drum 5 while one end thereof is secured to the outer peripheral surface of the rotary plate 3 by the set screw 8. Moment B due to the force of restitution of the band-shaped spring 6 acts on the rotary plate 3 in a clockwise direction as viewed in FIG. 1. The force of restitution of the spring 6 is constant until the spring 6 returns to its given radius of curvature, so that the resulting moment B is maintained at a constant value during rotation of the rotary plate 3, provided that the outer peripheral surface 30 of the rotary plate 3** has a constant curvature.

A radially extending rim **3*b* is formed on a lower side face of the rotary plate 3 for abutting against the stopper 2*e* of the lower cover 2 to normally hold the rotary plate 3 in a reference position in cooperation with the moment B acting thereon, as shown in FIG. 1**.

The switch 4 is a normally-open type, and comprises a fixed contact 41 and a movable contact 42, having respective base terminals **41*a* and 42*a* fixed to the bottom wall 2*a* of the lower cover 2 and insulated therefrom. The rotary plate 3 has a projection 3*c* formed integrally thereon at such a location that, when the plate 3 rotates by a predetermined angle from the reference position to an operative position shown in FIG. 4, the projection 3*c* urges the movable contact 42 into contact with the fixed contact 42*a*, thereby closing the switch 4. When the switch 4 is closed, an electrical (ON) signal is supplied through lead wires 9 to an occupant protective system, not shown, such as an inflatable air-bag system, connected to the collision sensor 1, to actuate the system. The switch 4 may be a normally-closed type, in place of the normally-open type switch, wherein it is arranged to be opened when the rotary plate 3** is rotated to the operative position.

The outer peripheral surface 30 of the rotary plate 3 has at least its entire effective operating portion (i.e. its entire effective peripheral surface portion) with a constant radius of curvature R, on which the band-shaped spring 6 is to be wound. Specifically, a constant radius of curvature R is given to at least the effective operating portion of the outer peripheral surface 30 of the rotary plate 3 between a point a, at which the moment B acts on the rotary plate 3 through the spring 6 when the plate 3 is in the reference position shown in FIG. 1, and a point b, at which the moment B acts on the rotary plate 3 through the spring 6 when the plate 3 is in the operative position shown in FIG. 4. Consequently, constant moment B acts upon the rotary plate 3 while the rotary plate 3 is rotated from the reference position to the operative position.

The collision sensor 1 constructed as above is installed in a vehicle, with the left end of the device 1 as viewed in FIG. 1 being ahead in the advancing direction.

The operation of the collision sensor 1 according to the first embodiment will now be explained.

When the vehicle is normally running, the moment B alone is applied to the rotary plate 3 by the band-shaped spring 6 to thereby hold the rotary plate 3 in the reference position, as shown in FIG. 1. However, when the vehicle is involved in a crash, for instance, to cause acceleration acting upon the device 1, moment of inertia C acts upon the rotary plate 3 in a counterclockwise direction as viewed in FIG. 1, to rotate the rotary plate 3 against the moment B from the reference position toward the operative position. When the rotary plate 3 reaches the operative position shown in FIG. 4, the projection 3*c* of the rotary plate 3 urges the movable contact 42 into contact with the fixed contact 41, thereby closing the switch 4, whereby the ON signal is supplied through the lead wires 9 to the occupant protective system to actuate the system.

Figure 4:
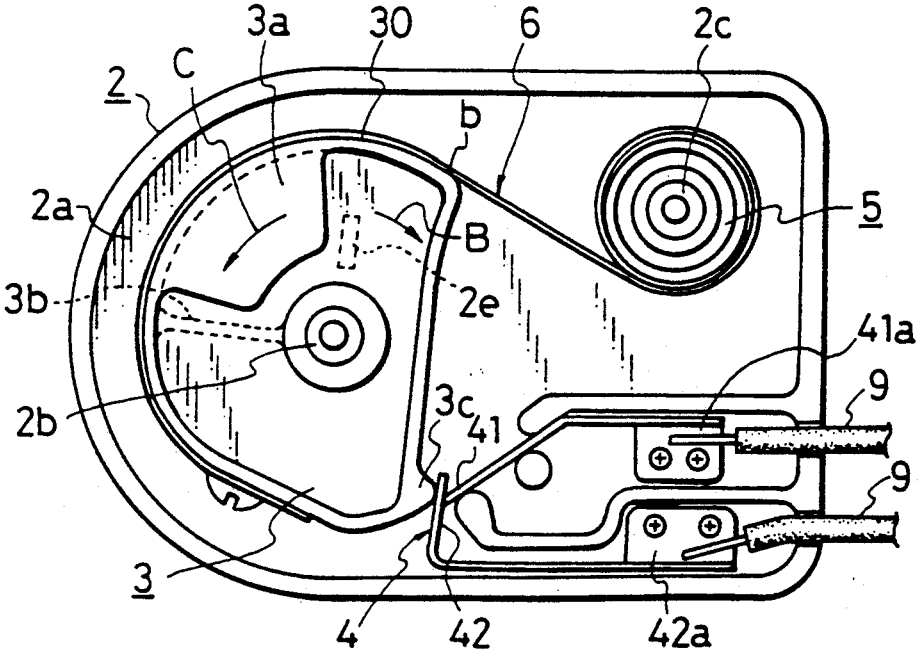
FIG. 4 is a view similar to FIG. 1, wherein the rotary plate is in an operative position.

As described above, according to the first embodiment, the urging moment B applied by the spring 6 is maintained constant during rotation of the rotary plate 3 from the reference position in FIG. 1 to the operative position in FIG. 4. Therefore, immediately when the device 1 undergoes acceleration in excess of a predetermined value so that the moment of inertia C acting on the rotary plate 3 overcomes the counteracting moment B, the rotary plate 3 starts to rotate. Then, if the acceleration continues over a predetermined time period, the rotary plate 3 reaches the operative position to close the switch 4. Therefore, in the first embodiment, it is possible to accurately set the critical value of acceleration at or above which the collision sensor 1 operates.

Figure 5:
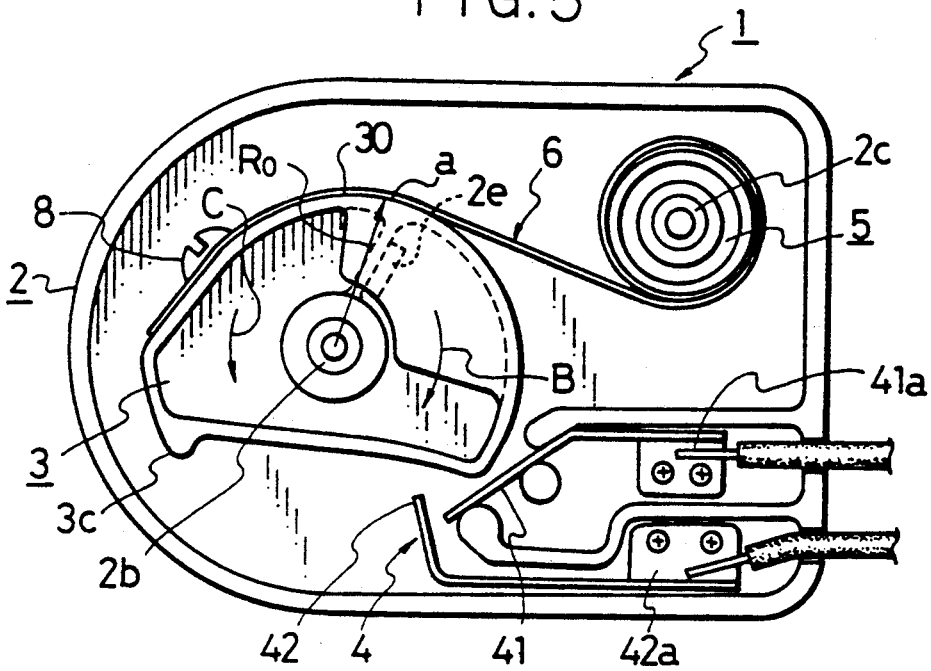
FIG. 5 is a view similar to FIG. 1, showing a second embodiment of the invention, wherein a rotary plate is in a reference position.
Figure 6:
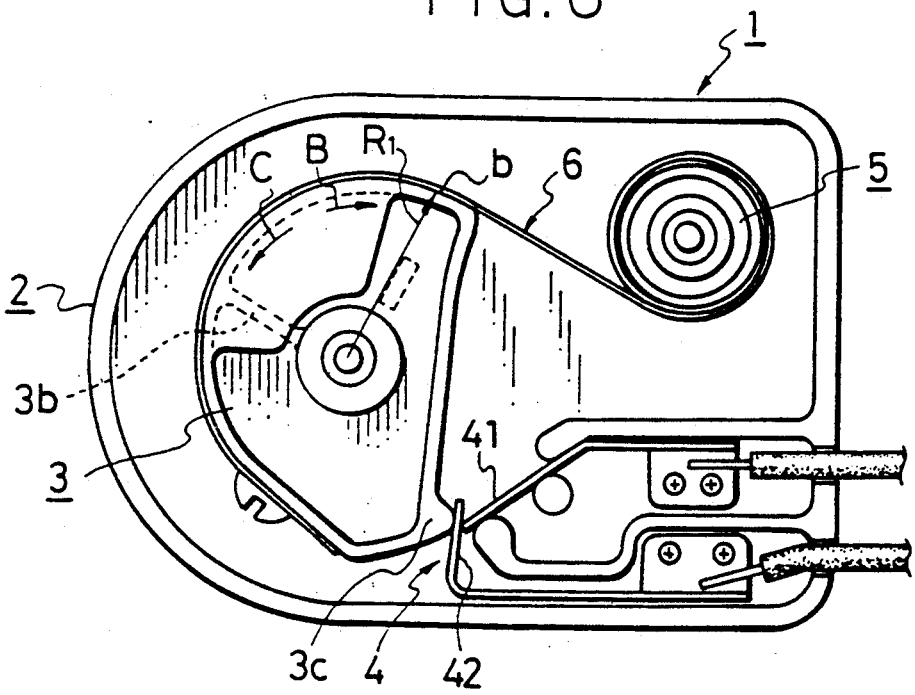
FIG. 6 is a view similar to FIG. 5, wherein the rotary plate is in an operative position.

FIGS. 5 and 6 show a second embodiment of the invention. The second embodiment is designed to progressively decrease the moment B as the rotary plate 3 rotates.

According to the second embodiment, the effective operating outer peripheral surface 30 of the rotary plate 3, on which the band-shaped spring 6 is to be wound, is configured such that the radius of curvature at the point at which the moment B acts upon the rotary plate 3 progressively increases (or the curvature progressively decreases) from $R_0$ to $R_1$, as the plate 3 rotates in the counterclockwise direction, i.e. from the point a to the point b, as viewed in FIGS. 5 and 6.

In the second embodiment constructed as above, as the rotary plate 3 rotates by a predetermined angle from the reference position shown in FIG. 5 to the operative position shown in FIG. 6, the curvature of the outer peripheral surface 30 of the rotary plate 3, at the point at which the moment B is applied by the band-shaped spring 6 to the rotary plate 3, progressively decreases from $1/R_0$ to $1/R_1$. Consequently, the moment B progressively decreases with the rotation of the rotary plate 3.

Figure 7:
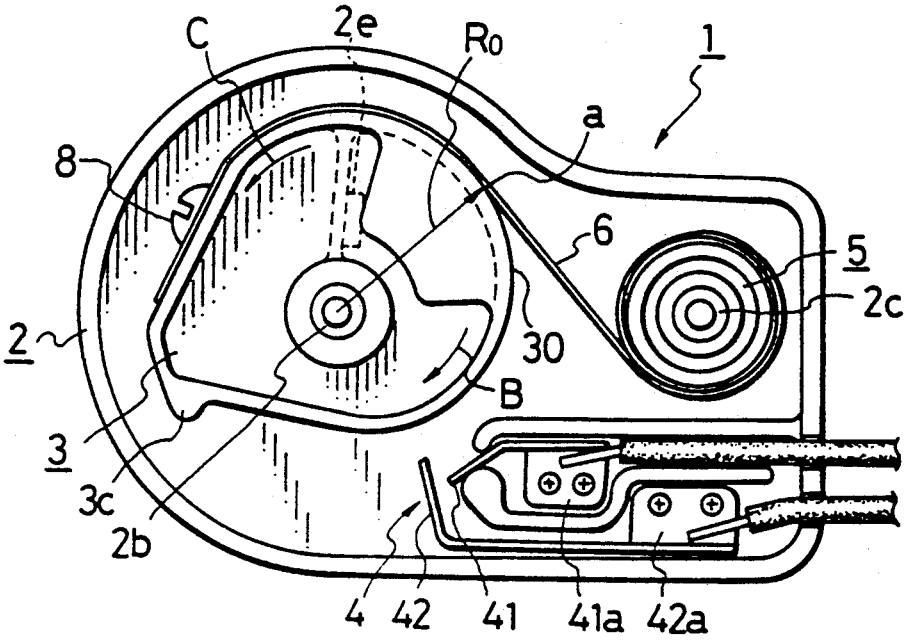
FIG. 7 is a view similar to FIG. 1, showing a third embodiment of the invention, wherein a rotary plate is in a reference position.
Figure 8:
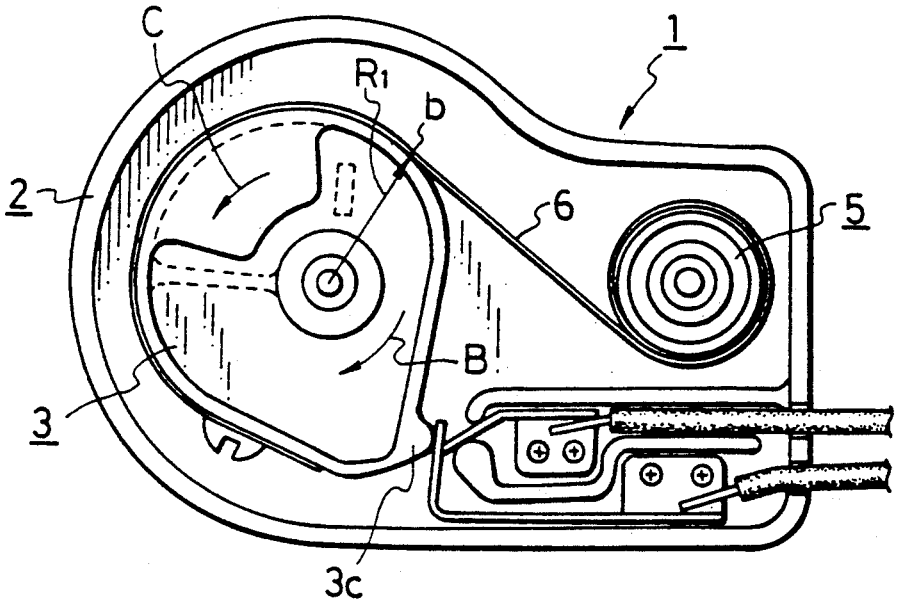
FIG. 8 is a view similar to FIG. 7, wherein the rotary plate is in an operative position.

FIGS. 7 and 8 show a third embodiment of the invention. The third embodiment is designed to progressively increase the moment B as the rotary plate 3 rotates, in a manner reverse to the second embodiment.

The effective operating outer peripheral surface 30 of the rotary plate 3, on which the band-shaped spring 6 is to be wound, is configured such that the radius of curvature at the point at which the moment B acts upon the rotary plate 3 progressively decreases (or the curvature progressively increases) from $R_0$ to $R_1$, as the plate 3 rotates in the counterclockwise direction from the point a to the point b in FIGS. 7 and 8.

In the third embodiment constructed as above, as the rotary plate 3 rotates by a predetermined angle from the reference position shown in FIG. 7 to the operative position shown in FIG. 8, the curvature of the outer peripheral surface 30 of the rotary plate 3, at the point at which the moment B acts upon the rotary plate 3, progressively increases from $1/R_0$ to $1/R_1$. Consequently, the urging moment B progressively increases with the rotation of the rotary plate 3.

FIGS. 9 to 13 show a fourth embodiment of the invention.

Figure 9:
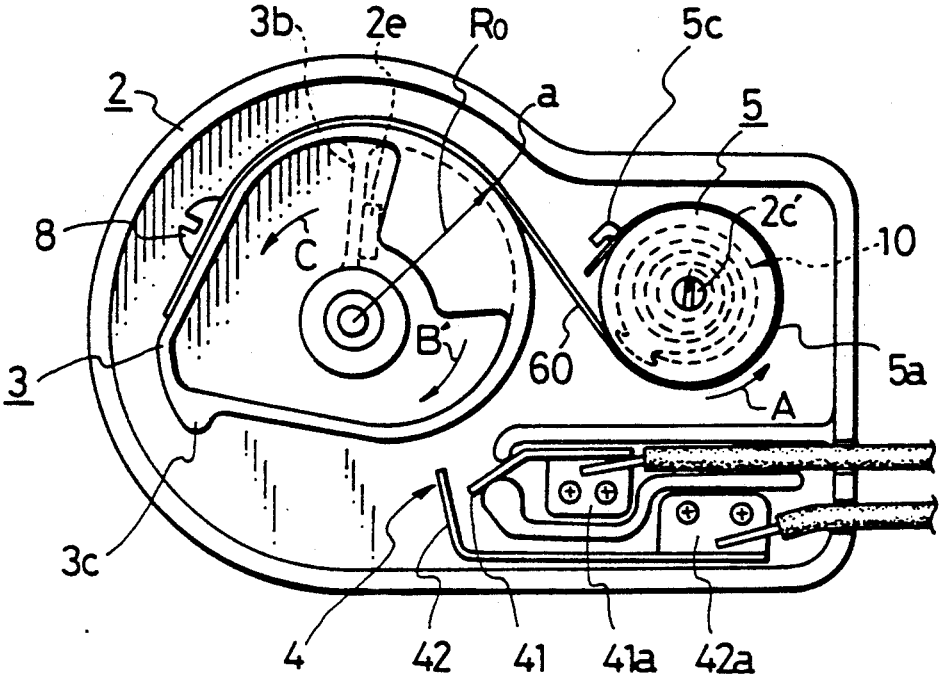
FIG. 9 is a view similar to FIG. 1, showing a fourth embodiment of the invention, wherein a rotary plate is in a reference position.
Figure 10:
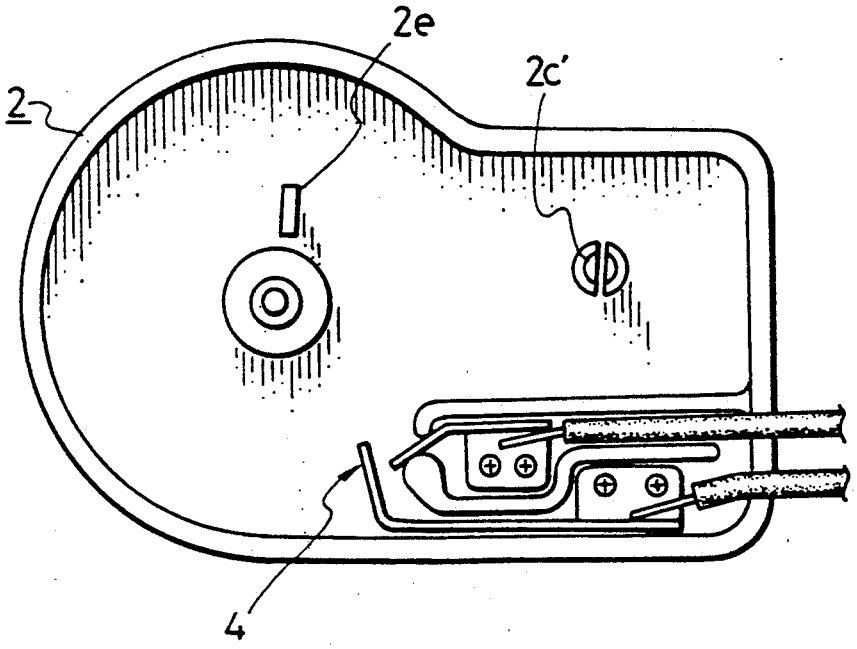
FIG. 10 is a plan view of a lower cover with a switch mounted thereon.
Figure 11:
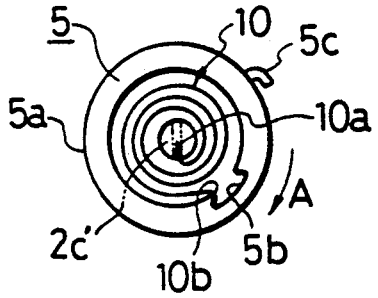
FIG. 11 is a view of a drum in FIG. 9, showing the bottom thereof.

As shown in FIG. 9, a spiral spring 10 is arranged within the drum 5 so as to apply a force to the drum 5 in a counterclockwise direction as viewed in FIG. 9. A strip in the form of a band or tape 60 formed of a metal sheet, a synthetic resin sheet, or a like strong sheet material such as cloth is used in place of the band-shaped spring 6 employed in the previous embodiments to connect between the rotary plate 3 and the drum 5. The effective operating outer peripheral surface 30 of the rotary plate 3 is configured such that the radius of curvature at the point at which the moment B acts upon the rotary plate 3 progressively decreases from $R_0$ to $R_1$, as the plate 3 rotates from the point a to the point b.

As shown in FIGS. 9 to 11, and 13, the drum 5 is rotatably supported by a support shaft 2*c*′ projected integrally from the bottom wall 2*a* of the lower cover 2. The spiral spring 10 is interposed between the support shaft 2*c*′ and the drum 5 with one end 10*a* thereof engaged in an engaging slit formed in the support shaft 2*c*′ and the other end 10*b* engaged in an engaging recess 5*b* formed in the inner peripheral wall of the drum 5, so that the drum 5 is acted upon by the force of the spiral spring 10. Since the force of the spiral spring 10 increases as the drum 5 is rotated in the clockwise direction as viewed in FIG. 9, the resulting moment A increases accordingly.

The strip 60 has one end portion thereof wound on the outer peripheral surface 5*a* of the drum 5 with its tip 10*a* engaged with an engaging projection 5*c* formed integrally on the outer peripheral surface 5*a*. The other end portion of the strip 60 extends along part of the outer peripheral surface of the rotary plate 3, with its tip secured to the outer peripheral surface of the rotary plate 3 by a set screw 8. Consequently, moment B′ which is caused by the moment A through the strip 60 acts upon the rotary plate 3 in the clockwise direction as viewed in FIG. 9.

Figure 12:
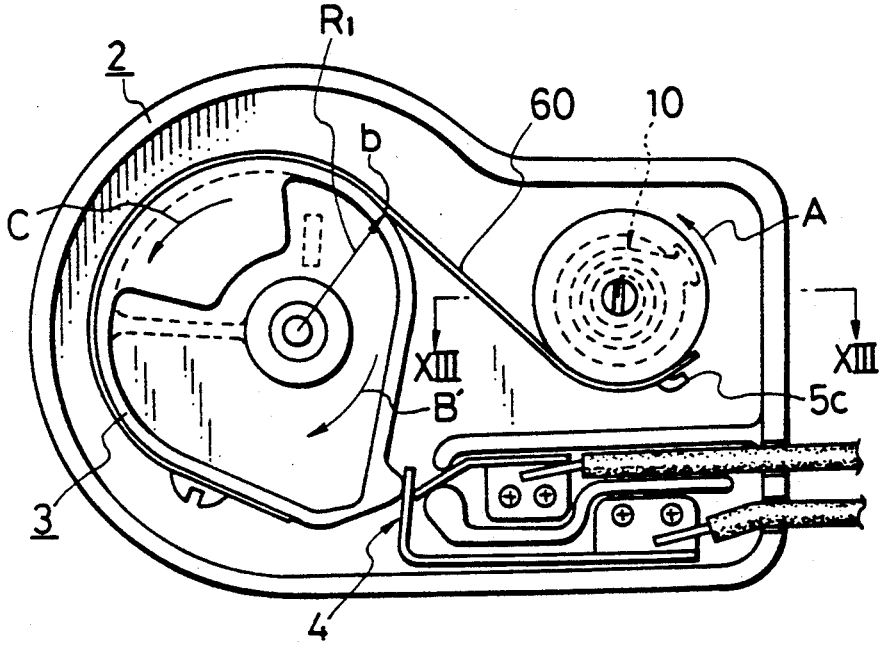
FIG. 12 is a view similar to FIG. 9, wherein the rotary plate is in an operative position.
Figure 13:
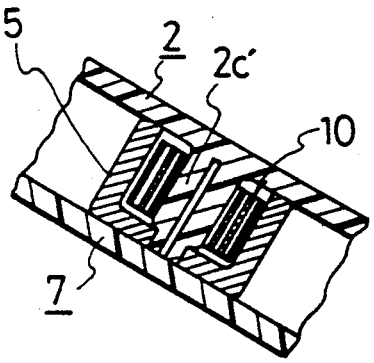
FIG. 13 is a sectional view taken along line XIII—XIII in FIG. 12.
Figure 14:
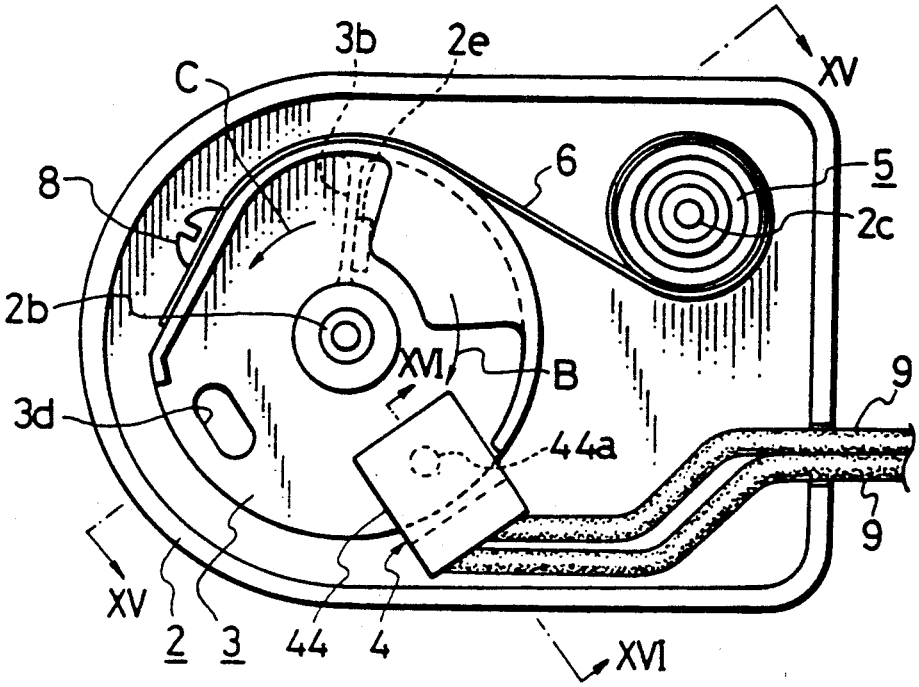
FIG. 14 is a view similar to FIG. 1, showing a fifth embodiment of the invention, wherein a rotary plate is in a reference position.
Figure 15:
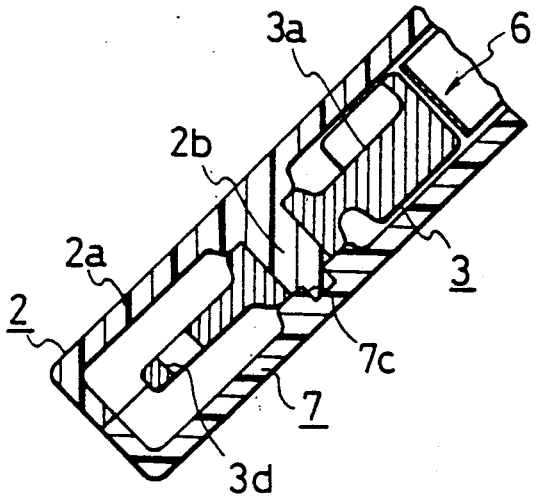
FIG. 15 is a sectional view taken along line XV—XV in FIG. 14.

In the fourth embodiment constructed as above, as the rotary plate 3 rotates by a predetermined angle from the reference position shown in FIG. 9 to the operative position shown in FIG. 12, the radius of curvature of the outer peripheral surface 5*a* of the rotary plate 5*a* at the point at which a force is applied by the moment A to the rotary plate 3 progressively decreases from $R_0$ to $R_1$, while the moment A acting on the drum 5 progressively increases. Consequently, the moment B' is maintained at almost a constant value during the rotation of the rotary plate 3.

Next, a fifth embodiment of the invention will be explained with reference to FIGS. 14 to 17.

Figure 16:
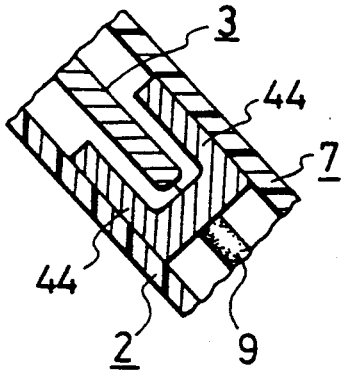
FIG. 16 is a sectional view taken along line XVI—XVI in FIG. 14.
Figure 17:
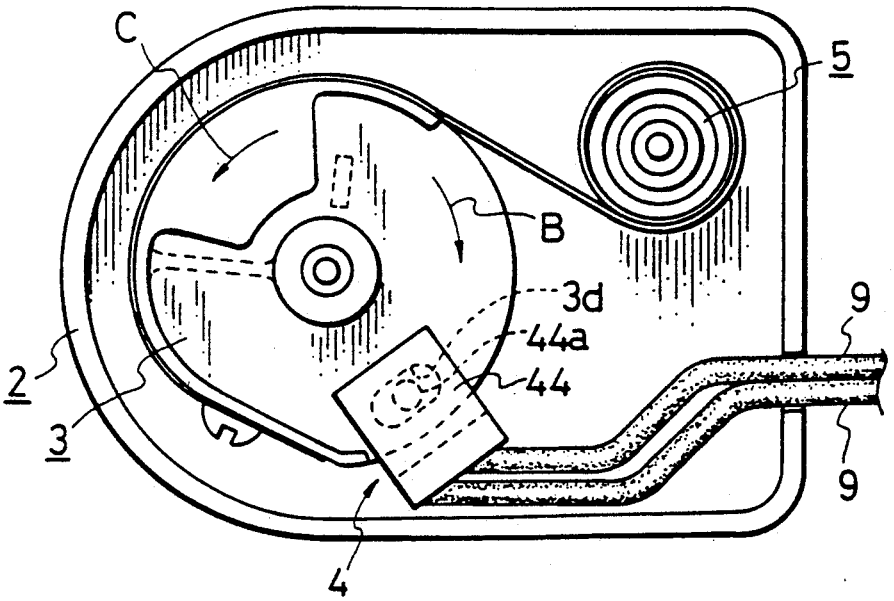
FIG. 17 is a view similar to FIG. 14, wherein the rotary plate is in an operative position.

The fifth embodiment is different from the first embodiment only in that a photoelectric switch is employed as the switch 4. The switch 4 has a sensor housing 44 having an U-shaped section into which the outer peripheral edge of the rotary plate 3 is inserted as shown in FIG. 16. A through hole 3*d* is formed through the rotary plate 3 at such a location that the hole 3*d* registers with a photoelectric sensing element 44*a* of the switch 44 when the rotary plate 3 is rotated to the operative position shown in FIG. 17 from the reference position shown in FIG. 14. When the through hole 3*d* registers with the photoelectric sensing element 44*a*, the photoelectric switch 4 is energized to supply an electrical (ON) signal through the lead wires 9 to the occupant protective system.

FIGS. 18 to 21 show a sixth embodiment of the invention.

The sixth embodiment is provided with a damper to restrain the rotary plate 3 from rotating to the operative position, in order to prevent the occupant protective system from operating when a large degree of acceleration occurs over a very short time period.

Figure 18:
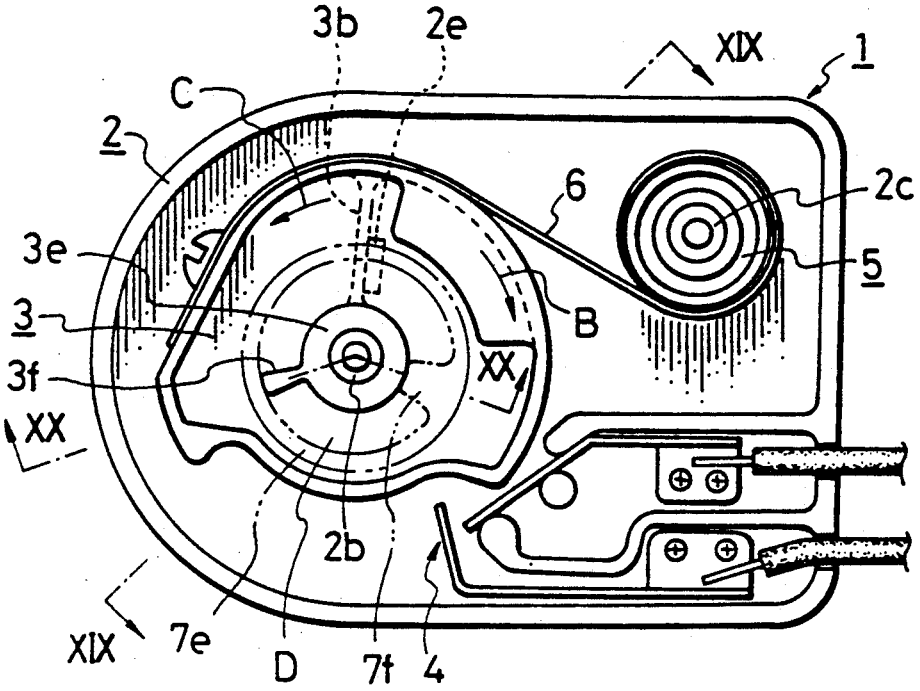
FIG. 18 is a view similar to FIG. 1, showing a sixth embodiment of the invention, wherein a rotary plate is in a reference position.
Figure 19:
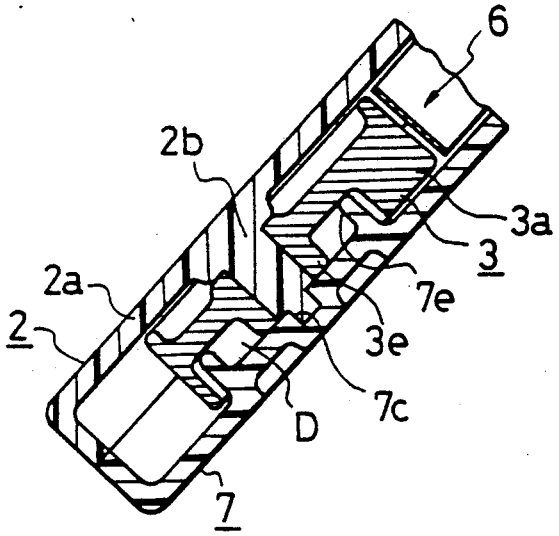
FIG. 19 is a sectional view taken along line XIX—XIX in FIG. 18.
Figure 20:
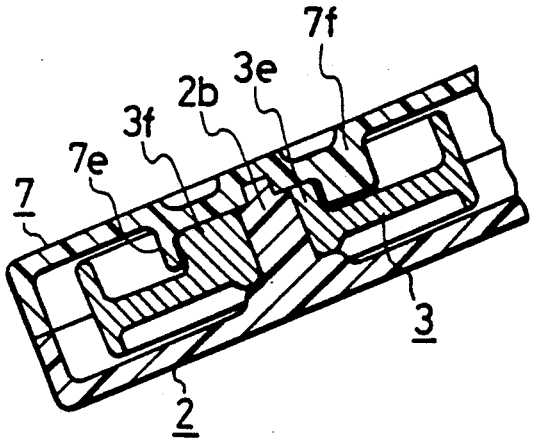
FIG. 20 is a sectional view taken along line XX—XX in FIG. 18.

As shown in FIGS. 18 to 20, the rotary plate 3 has an integral hub 3*e* rotatably fitted on the support shaft 2*b* of the lower cover 2 and formed integrally with a radial wall 3*f* radially projected therefrom, whereas the upper cover 7 has an annular wall 7*e* downwardly pending integrally therefrom such that the radial wall 3*f* of the rotary plate 3 is in slidable contact with the inner peripheral surface of the annular wall 7*e*. The annular wall 7*e* has its inner peripheral surface formed integrally with a projection 7*f* in slidable contact with the outer peripheral wall of the hub 3*e*, to define a damper chamber D between the radial wall 3*f* and the projection 7*f*.

Figure 21:
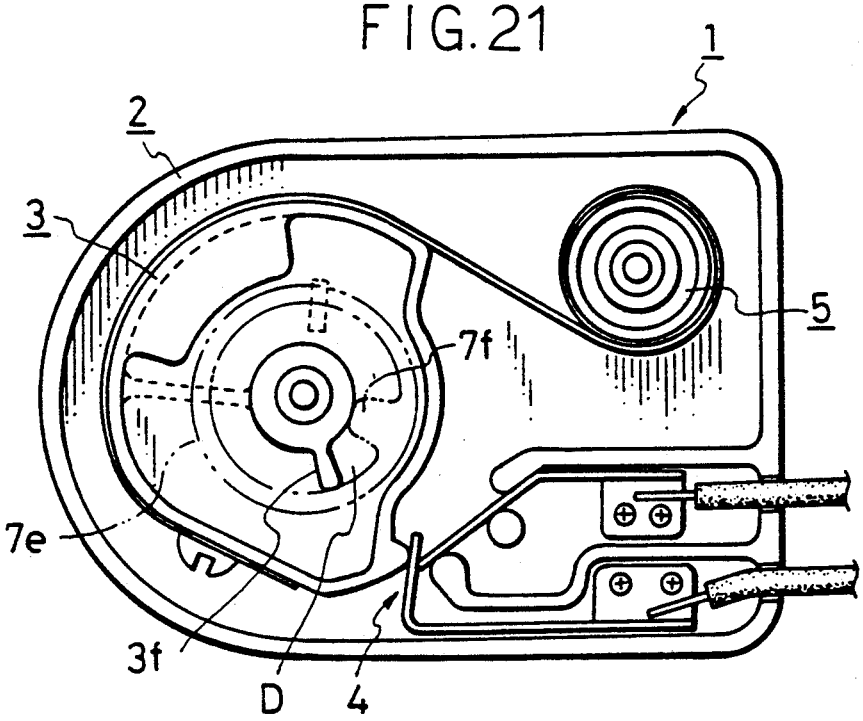
FIG. 21 is a view similar to FIG. 14, wherein a rotary plate is in an operative position.

In the sixth embodiment constructed as above, as the rotary plate 3 rotates in the counterclockwise direction from the reference position shown in FIG. 18 toward the operative position shown in FIG. 21, the volume of the damper chamber D progressively decreases to thereby progressively increase the pressure therein and hence create a force acting on the rotary plate 3 to restrain same from rotating toward the operative position. Due to the restraining force, the rotary plate 3 is allowed to rotate to the operative position only when the vehicle is involved in a crash to undergo a large degree of deceleration over a predetermined time period, but the rotary plate 3 is inhibited from rotating to the operative position when the vehicle undergoes a large degree of deceleration over a time period shorter than the predetermined time period.

Figure 22:
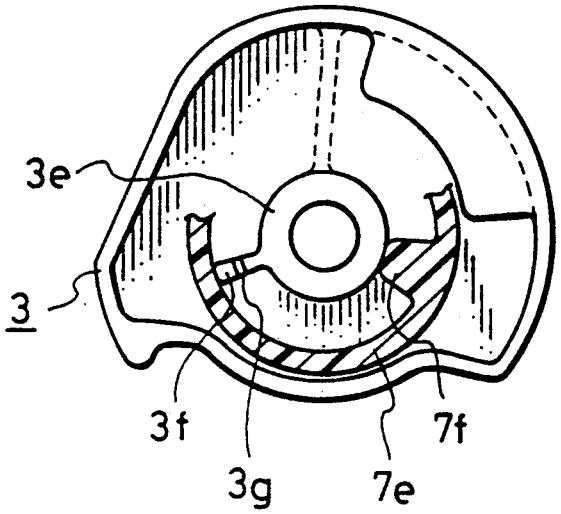
FIG. 22 is a plan view of essential parts of the device, according to a modification of the sixth embodiment.

The sixth embodiment may be modified as shown in FIG. 22, wherein a slit 3*g* or a hole having a suitable opening area is formed through the radial wall 3*f* to permit the pressure within the damper chamber D to leak therethrough, making it possible to properly set the restraining force.

Figure 23:
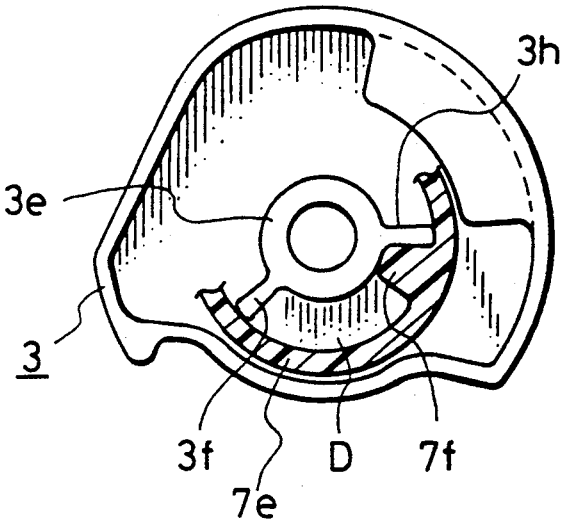
FIG. 23 is a plan view of essential parts of the device, according to another modification of the sixth embodiment.

Further, the sixth embodiment may be also modified as shown in FIG. 23, wherein another radial projection wall 3*h*, in addition to the radial wall 3*f*, is formed integrally with the hub 3*e* such that the radial wall 3*h* abuts against an opposed side surface of the projection wall 7*f* when the rotary plate 3 is in the reference position.

According to the FIG. 23 modification, as the rotary plate 3 rotates in the counterclockwise direction from the reference position shown in FIG. 23 toward the operative position, the volume of the first damper chamber D defined between the radial wall 3*f* and the projection 7*f* progressively decreases to increase the positive pressure therein, and simultaneously the volume of the second damper chamber defined between the radial wall 3*h* and the projection 7*f* progressively increases to increase the negative pressure therein, thereby exerting a greater restraining force on the rotary plate 3 than that in the sixth embodiment of FIG. 22.

Further, according to the FIG. 23 embodiment when the rotary plate is in the reference position shown in FIG. 23, the radial wall 3*h* abuts against the opposed side surface of the projection wall 7*f*. This serves to positively hold the rotary plate 3 in the reference position, thereby making it possible to omit the stopper 2*e* as well as the rim 3*b* as used in the first embodiment and hence simplify the structure of the collision sensor 1.

Figure 24:
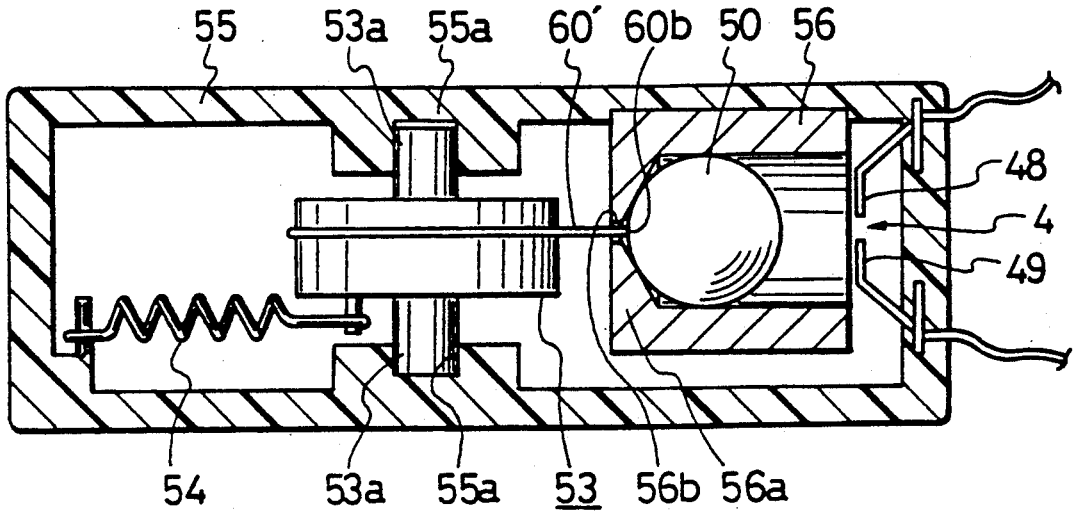
FIG. 24 is a longitudinal cross-sectional view of a collision sensor according to a seventh embodiment of the invention.
Figure 25:
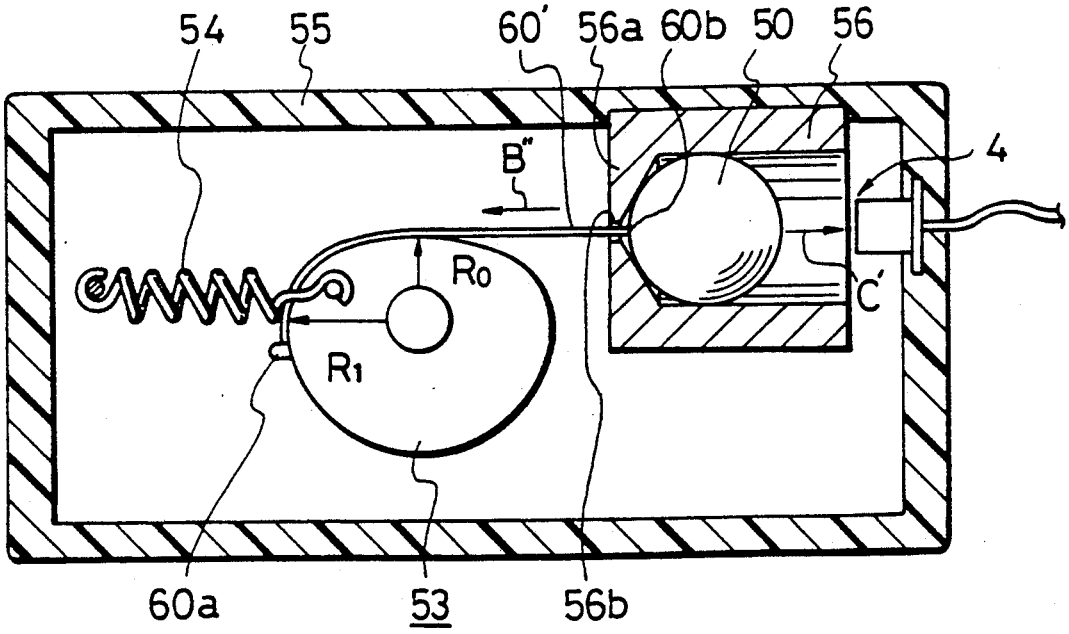
FIG. 25 is a transverse cross-sectional view of the device of FIG. 24.

Referring next to FIGS. 24 and 25, a seventh embodiment of the invention will be explained.

The collision sensor according to the seventh embodiment comprises a casing 55, a steel ball (inertial mass) 50 received within the casing 55 for movement against an urging force acting thereon, a switch 4 arranged to be closed when the steel ball 50 has moved by a predetermined amount from the reference position, a rotary plate 53, a flexible thread 60' wound on the outer peripheral surface of the rotary plate 53 with one end 60*a* thereof secured thereto and the other end 60*b* secured to the steel ball 50, a coiled spring 54 having one end thereof secured to the rotary plate 53 and the other end fixed to the casing 55 so as to apply the aforesaid urging force to the steel ball 50 to urge same toward the reference position.

The steel ball 50 is slidably received within a cylinder 56 fixed to an inner wall of the casing 55. The cylinder 56 has an end wall 56*a* formed therein with a through hole 56*b* through which the flexible thread 60 extends. Another end of the cylinder 56 is open and opposed to a pair of fixed contacts 48, 49 of the switch fixed to the casing 55.

The flexible thread 60' is formed by a wire or a string formed of synthetic resin or a like strong material.

The rotary plate 53 is secured on a shaft 53*a* which penetrates therethrough and rotatably supportedly engaged in opposite recesses 55*a*, 55*a* formed in the casing 55. The outer peripheral surface of the rotary plate 53 has a portion thereof, on which the flexible thread 60' is wound, configured such that the radius of curvature at the point at which the force is applied by the steel ball 50 through the flexible thread 60 to the rotary plate 53 progressively increases (i.e. the curvature progressively decreases) from $R_0$ to $R_1$, as the rotary plate 53 rotates in the counterclockwise direction from the reference position shown in FIG. 25 to the operative position with movement of the steel ball 50 from the reference position shown in the same figure to the fixed contacts 48, 49. Consequently, a biasing force B", which is applied to the steel ball 50 through the flexible thread 60' by the coiled spring 54 connected between the casing 55 and the rotary plate 53, progressively decreases as the steel ball 50 moves from the reference position toward the fixed contacts 48, 49, i.e. as the rotary plate 53 rotates in the clockwise direction from the reference position.

The operation of the seventh embodiment will be explained hereinbelow.

When the vehicle is involved in a crash, for instance, to undergo deceleration, an inertial force C' acts upon the steel ball 50, in a direction shown in FIG. 25. If the inertial force C' surpasses the biasing force B", the steel ball 50 starts to move within the cylinder 56 toward the fixed contacts 48, 49. When the inertial force C' continues to act upon the steel ball 50 to bring same into contact with the fixed contacts 48, 49, the switch 4 is closed to actuate the occupant protective system. During the rotation of the rotary plate 53, the biasing force B" acting on the steel ball 50 progressively decreases with a progressive increase in the radius of curvature of the outer peripheral surface of the rotary plate 53 at the point at which the force is applied to the plate 53 from $R_0$ to $R_1$.

Alternatively, the outer peripheral surface of the rotary plate 53 may be configured such that the radius of curvature at the point where the force is applied to the plate 53 progressively decreases (the curvature progressively increases) from $R_0$ to $R_1$, as the plate 53 rotates in the clockwise direction from the reference position shown in FIG. 25, in the reverse manner to the seventh embodiment. Then, the biasing force B" acting on the steel ball 50 by the coiled spring 54 progressively increases as the steel ball 50 moves from the reference position toward the fixed contacts 48, 49.

Further, the outer peripheral surface of the rotary plate 53 may also be configured such that the radius of curvature at the point where the force is applied to the plate 53 remains constant (the curvature constant) from $R_0$ to $R_1$, as the plate 53 rotates in the clockwise direction from the reference position shown in FIG. 25, like the first embodiment in FIG. 1. Then, the biasing force B" acting on the steel ball 50 by the coiled spring 54 remains constant as the steel ball 50 moves from the reference position toward the fixed contacts 48, 49.

As described above with respect to the first to seventh embodiments, the biasing force (or biasing moment) B, B', B" acting on the rotary plate 3 or the steel ball 50 as the inertial mass can be varied to desired values by simply setting the radius of curvature of the outer peripheral surface of the rotary plate 3, 53 on which the flexible element (the band-shaped spring 6 or the band-shaped strip 60 or the flexible thread 60') is to be wound. As a result, the range of the spring constant that can be selected to detect desired patterns of acceleration is expanded, thereby improving the freedom of design of the spring (the band-shaped spring 6, the spiral spring 10, or the coiled spring 54).

Figure 26:
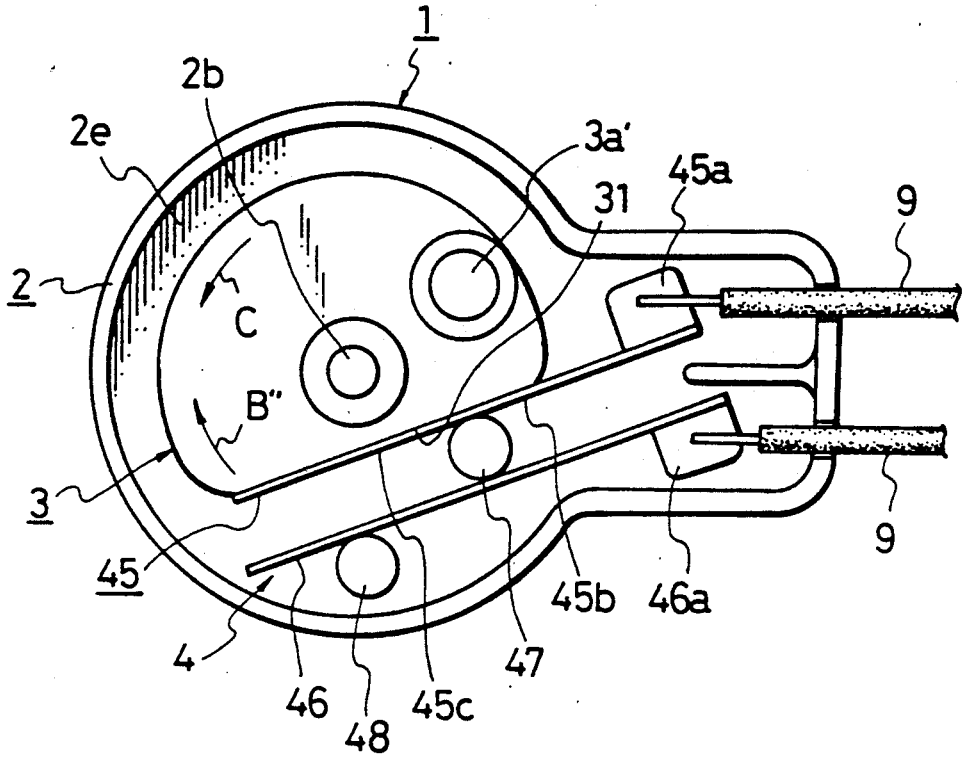
FIG. 26 is a plan view similar to FIG. 1, showing an eighth embodiment of the invention.

FIG. 26 shows an eighth embodiment of the invention.

The eighth embodiment employs a switch 4 which comprises movable and fixed contacts 45, 46 each formed by a leaf spring, having respective base terminals 45*a*, 45*b* fixed to the bottom wall 2*e* of the lower cover 2 and extending parallel with each other. The outer peripheral surface of the rotary plate 3 has a straight portion 31 with which the movable contact 45 is in urging contact. The movable and fixed contacts 45, 46 are positioned in place, respectively, by supports 47, 48 projected from the bottom wall 2*e* of the lower cover 2. A weight 3*a*' is mounted in the rotary plate 3 at a location deviated from the axis of the plate 3.

The movable contact 45 has a stopper portion 45*b* closer to the base terminal 45*a* with respect to the support 47, which serves as a stopper for holding the rotary plate in the reference position, and a spring portion 45*c* remote from the base terminal 45*a* with respect to the support 47, which serves as a spring for applying an biasing force B" to the rotary plate to bias same toward the reference position. That is, as the rotary plate 3 rotates in the counterclockwise direction as viewed in FIG. 26 from the reference position toward the operative position, the spring portion 45*c* of the movable contact 45 is deformed toward the fixed contact 46 about the support 47. When the rotary plate rotates to the operative position, the tip of the spring portion 45*c* of the movable contact 45 contacts with an opposed end of the fixed contact 46, thereby closing the switch 4.

What is claimed is:

1. A collision sensor comprising:

a rotary element rotatable about an axis of rotation thereof, said rotary element having an outer peripheral surface provided with a predetermined curvature characteristic;

first support means for rotatably supporting said rotary element;

an elongate flexible element having one end secured to second support means arranged in a spaced relation to said first support means and another end portion wound on at least part of said outer peripheral surface of said rotary element;

biasing means for generating a biasing force for biasing said rotary element through said flexible element to a predetermined position;

weight means arranged on said rotary element at a location deviated from an axis of rotation of said rotary element, said weight means being responsive to acceleration acting thereupon for causing said rotary element to rotate against said biasing force from said predetermined position; and switch means operable to generate an output signal when said rotary element has rotated by a predetermined angle from said predetermined position;

wherein said elongate flexible element is wound onto or unwound from said outer peripheral surface of said rotary element when said rotary element rotates so that said biasing force of said biasing means is modulated in accordance with said predetermined curvature characteristic.

2. A collision sensor comprising:

a first support shaft;

a rotary element supported by said first support shaft for rotation about an axis of rotation thereof, said rotary element having an outer peripheral surface provided with a predetermined curvature characteristic;

a second support shaft arranged in spaced relation to said first support shaft;

a drum rotatably supported on said second support shaft, an elongate flexible element having one end portion thereof wound on said outer peripheral surface of said rotary element and another end portion thereof wound on said drum;

biasing means for generating a biasing force for biasing said rotary element through said flexible element to a predetermined position;

said biasing force of said biasing means being modulated in accordance with said predetermined curvature characteristic as said rotary element rotates;

weight means arranged on said rotary element at a location deviated from an axis of rotation of said rotary element, said weight means being responsive to acceleration acting thereupon for causing said rotary element to rotate against said biasing force from said predetermined position; and switch means operable to generate an output signal when said weight means has moved by a predetermined distance from said predetermined position.

3. The collision sensor as claimed in claim 2, wherein said elongate flexible element is a band-shaped spring also forming said biasing means.

4. The collision sensor as claimed in claim 2, wherein said biasing means comprises a spiral spring interposed between said drum and said second support shaft, said elongate flexible element comprising a band-shaped strip.

5. The collision sensor as claimed in claim 2, wherein said outer peripheral surface of said rotary element has a region upon which said biasing force acts through said elongate flexible element at least while said rotary element rotates by said predetermined angle from said predetermined position, said region having a constant radius of curvature from a starting end thereof to a terminating end thereof.

6. The collision sensor as claimed in claim 2, wherein said outer peripheral surface of said rotary element has a region upon which said biasing force acts through said elongate flexible element at least while said rotary element rotates by said predetermined angle from said predetermined position, said region having a radius of curvature progressively increasing from a starting end thereof to a terminating end thereof.

7. The collision sensor as claimed in claim 2, wherein said outer peripheral surface of said rotary element has a region upon which said biasing force acts through said elongate flexible element at least while said rotary element rotates by said predetermined angle from said predetermined position, said region having a radius of curvature progressively decreasing from a starting end thereof to a terminating end thereof.

8. The collision sensor as claimed in claim 2, wherein said switch means comprises a photoelectric switch.

9. A collision sensor as claimed in claim 8 and further comprising a casing, wherein said switch means comprises a photoelectric switch having a sensor housing fixed to said casing, a photoelectric sensing element provided in said sensor housing, and an opening formed in said rotary element at such a location that said opening registers with said photoelectric sensing element when said rotary element is rotated to a predetermined operative position.

10. A collision sensor comprising:

a rotary element rotatable about an axis of rotation thereof, said rotary element having an outer peripheral surface thereof provided with a predetermined curvature characteristic;

support means for rotatably supporting said rotary element;

a weight element formed in a separate body from said rotary element, said weight element being movable in response to acceleration acting thereupon against a biasing force from a predetermined position;

an elongate flexible element having one end thereof secured to said weight element, and another end portion thereof wound on at least part of said outer peripheral surface of said rotary element;

biasing means engaging with said rotary element for generating said biasing force for biasing said weight element to said predetermined position through said elongate flexible element;

said biasing force of said biasing means being modulated in accordance with said predetermined curvature characteristic as said rotary element rotates; and switch means operable to generate an output signal when said weight element has moved by a predetermined distance from said predetermined position.

11. The collision sensor as claimed in claim 10, wherein said elongate flexible element comprises a flexible thread.

12. The collision sensor as claimed in claim 10, wherein said weight element comprises a ball.

13. The collision sensor as claimed in claim 12, including a cylinder within which said ball is slidably received, said cylinder having one end thereof formed with a through hole through which said elongate flexible element extends, and another end thereof being open and opposed to said switch means.

14. The collision sensor as claimed in claim 10, wherein said biasing means comprises a coiled spring having one end thereof being stationary, and another end thereof secured to said rotary element.

15. The collision sensor as claimed in claim 10, wherein said outer peripheral surface of said rotary element has a region upon which said biasing force acts through said elongate flexible element while said rotary element rotates in accordance with movement of said weight element by a predetermined distance from said predetermined position, said region having a radius of curvature progressively increasing from a starting end thereof to a terminating end thereof.

16. The collision sensor as claimed in claim 10, wherein has a region upon which said biasing force acts through said elongate flexible element while said rotary element rotates in accordance with movement of said weight element by a predetermined distance from said predetermined position, said region having a radius of curvature progressively decreasing from a starting end thereof to a terminating end thereof.

17. The collision sensor as claimed in claim 10, wherein said outer peripheral surface of said rotary element has a region upon which said biasing force acts through said elongate flexible element while said rotary element rotates in accordance with movement of said weight element by a predetermined distance from said predetermined position, said region having a radius of curvature being constant from a starting end thereof to a terminating end thereof.

18. A collision sensor comprising:

a rotary element rotatable about an axis of rotation thereof, said rotary element having an outer peripheral surface provided with a predetermined curvature characteristic;

first support means for rotatably supporting said rotary element;

an elongate flexible element having one end secured to second support means, and another end wound on at least part of said outer peripheral surface of said rotary element;

biasing means for generating a biasing force for biasing said rotary element through said flexible element to a predetermined position;

said biasing force of said biasing means being modulated in accordance with said predetermined curvature characteristic as said rotary element rotates;

weight means arranged on said rotary element at a location deviated from an axis of rotation of said rotary element, said weight means being responsive to acceleration acting thereupon for causing said rotary element to rotate against said biasing force from said predetermined position;

switch means operable to generate an output signal when said rotary element has rotated by a predetermined angle from said predetermined position; and restraining means for applying to said rotary element a restraining force progressively increasing as said rotary element rotates away from said predetermined position.

19. The collision sensor as claimed in claim 18, wherein said restraining means comprises a damper chamber defined by part of said rotary element, said damper chamber having a volume thereof progressively decreasing as the rotary element rotates away from said predetermined position.

20. The collision sensor as claimed in claim 18, wherein said restraining means comprises a first damper chamber defined by one part of said rotary element, said first damper chamber having a volume thereof progressively decreasing as said rotary element rotates away from said predetermined position, and a second damper chamber defined by another part of said rotary element, said second damper chamber having a thereof progressively increasing as said rotary element rotates away from said predetermined position.

21. A collision sensor comprising:

a rotary element rotatably supported about an axis of rotation thereof, said rotary element having an outer peripheral surface thereof provided with a predetermined curvature characteristic;

support means for rotatably supporting said rotary element;

a weight element formed in a separate body from said rotary element, said weight element being movable in response to acceleration acting thereupon against a biasing force from a predetermined position;

an elongate flexible element having one end thereof secured to said weight element, and another end portion thereof wound on at least part of said outer peripheral surface of said rotary element;

biasing means engaging with said rotary element for generating said biasing force for biasing said weight element to said predetermined position through said elongate flexible element; and switch means operable to generate an output signal when said weight element has moved by a predetermined distance from said predetermined position;

wherein said elongate flexible element is wound onto or unwound from said outer peripheral surface of said rotary element when said rotary element rotates in a manner such that said biasing force of said biasing means is modulated in accordance with said predetermined curvature characteristic.

22. A collision sensor comprising:

a rotary element rotatably supported about an axis of rotation thereof, said rotary element having an outer peripheral surface provided with a predetermined curvature characteristic;

first support means for rotatably supporting said rotary element;

an elongate flexible element having one end secured to second support means, and another end wound on at least part of said outer peripheral surface of said rotary element;

biasing means for generating a biasing force for biasing said rotary element through said flexible element to a predetermined position;

weight means arranged on said rotary element at a location deviated from an axis of rotation of said rotary element, said weight means being responsive to acceleration acting thereupon for causing said rotary element to rotate against said biasing force from said predetermined position;

switch means operable to generate an output signal when said rotary element has rotated by a predetermined angle from said predetermined position; and restraining means for applying to said rotary element a restraining force progressively increasing as said rotary element rotates away from said predetermined position;

wherein said elongate flexible element is wound on or unwound from said outer peripheral surface of said rotary element when said rotary element rotates in a manner such that said biasing force of said biasing means is modulated in accordance with said predetermined curvature characteristic.

* * * * *